United States Patent [19]

Schnapp

[11] Patent Number: 4,790,714

[45] Date of Patent: Dec. 13, 1988

[54] EXPANDABLE CUBE TOY

[76] Inventor: Abraham Schnapp, 28 Yaffo Street, Haifa, Israel

[21] Appl. No.: 811

[22] Filed: Dec. 31, 1986

[51] Int. Cl.[4] ..... A63H 33/00

[52] U.S. Cl. ..... 446/486; 446/488

[58] Field of Search ..... 446/488, 85, 487, 486, 446/491; 272/27 N, 8 N

[56] References Cited

U.S. PATENT DOCUMENTS 3,234,682 2/1966 Frankl ..... 446/85

FOREIGN PATENT DOCUMENTS 1317155 5/1973 United Kingdom ..... 446/488

*Primary Examiner*—Mickey Yu

*Attorney, Agent, or Firm*—Morton Friedman

[57] ABSTRACT

A toy in the shape of a collapsible and expandable box is made of cardboard and has a stiff, square top and bottom and four side walls which can be folded to the outside along central folding lines by pressure onto the top. Each side wall is provided with an inwardly extending tongue, and each two tongues on opposite side walls are connected by elastic bands or springs which pull the walls back from their folded position into planar state, as soon as the pressure on the top is released. In this position the toy forms a cube, which may be decorated with pictures, maps, symbols or the like.

9 Claims, 3 Drawing Sheets

EXPANDABLE CUBE TOY

BACKGROUND OF THE INVENTION

The invention relates to toy in the shape of a collapsible and expandable box. It relates particularly to a box which is flat as long as pressure is applied onto its top, and expands suddenly into box-shape as soon as the pressure is released.

Many kinds of toys consist of a figure of a living or an inanimate being enclosed in a box, which is made to jump out as soon as the box is opened. These toys are also made to amuse or even somewhat frighten children in that a devil or clown previously enclosed and hidden, extends far above the box by means of a helical spring enclosed in a sort of bellows. In general these toys comprise helical or other springs which bear at their one end on the box bottom, and at their other on the figure to be ejected. By pressure from above the spring is compressed and the figure is re-enclosed in the box.

Contrary to these existing toys, it is the object of the present invention to provide a toy which has not only a surprise effect but which—after the box or boxes have expanded—should serve as an educational toy or a competitive game by having its top an sides covered with pictures, maps drawings, symbols and the like.

SUMMARY OF THE INVENTION

The toy of the invention consists in a hollow box, either of rectangular or square ground plan which can be completely flattened by pressure to a thickness of a few millimeters, permitting the insertion of a multitude of similar boxes into a cardboard, plastic or wooden container, one above the other. In flattened state their plan is that of a cross, either oblong in the case of a brick-shaped box, or square in the case of a cube. Upon opening the lid of the container, all—or usually all—boxes will be flung out and spread across the room, by internal spring means which are adapted to unfold the sides of the box and to give it an upward momentum.

The box of the invention has an inside and outside and is made of a thin sheet of cardboard or plastics; it consists of a rectangular or square bottom and top of stiff consistency connected by four rectangular or square side-walls, all of the same height, which are notched along their center lines parallel to the planes of the top and bottom, permitting their folding in outward direction, thus causing the complete approach of top and bottom. According to one embodiment of the invention, each side wall is provided with a tongue extending inwardly from the center line coexistent with the notch, and the two tongues attached to opposite side walls of the box are interconnected by elastic contracting means, such as springs or rubber bands. The tongues extending from opposite sides are each of a length which added are coexistent with the distance between the opposed side walls; this limits the movement of the side walls, since the ends of the tongues contact as soon as the two halves of the side walls are in a common plane, and prevents the springs from drawing the side walls further inwards.

In a preferred embodiment, the components of the box are cut out from one or two pieces of cardboard in a contiguous pattern. This is so notched that the top, bottom, side walls and tongues are folded from this pattern into box-shape and that the tongues are formed from two layers of material and are accordingly strong, and that each side wall is composed of an upper and a lower half, each continuing in a tongue. The tongues are perforated by holes or slots at points distanced from their inner ends, and the ends of springs or rubber bands are fastened in these perforations, offering them the length necessary for contracting the tongues and side walls.

The outside of the top, the bottom and/or the side walls may be covered with pictures which are either directly printed thereon or attached by adhesives.

SHORT DESCRIPTION OF THE DRAWINGS

FIG. 1 is an isometric view of a box of the invention in almost completely flattened state, FIG. 2 is an isometric view of the box of FIG. 1, in half expanded state, FIG. 3 is an isometric view of the box of FIG. 1, just before being fully expanded into a cube, FIG. 4 is a cross section through the box of the invention in half-expanded state, as shown in FIG. 2, FIG. 5 is a plan view of a cardboard pattern serving to be bent and folded to form a box of the invention, the pattern being shown notched and in the process of folding, and FIG. 6 is a side view of the cardboard pattern of FIG. 5.

DESCRIPTION OF A PREFERRED EMBODIMENT

Figure 1:
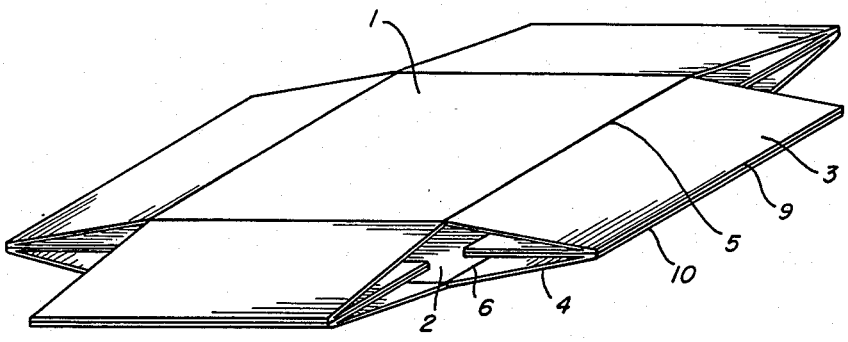
Figure 2:
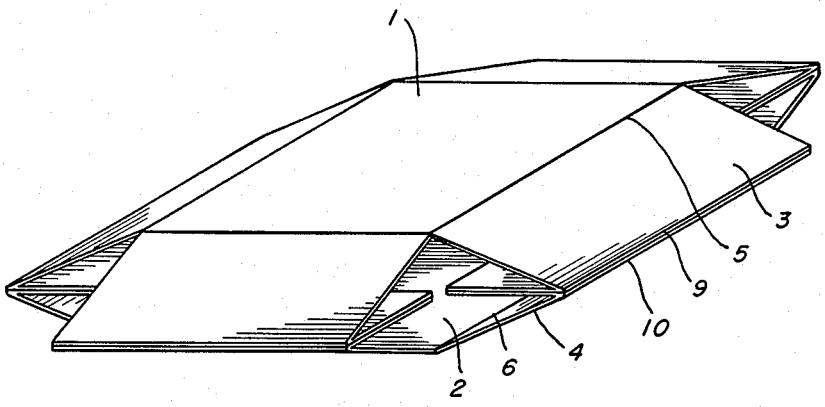
Figure 3:
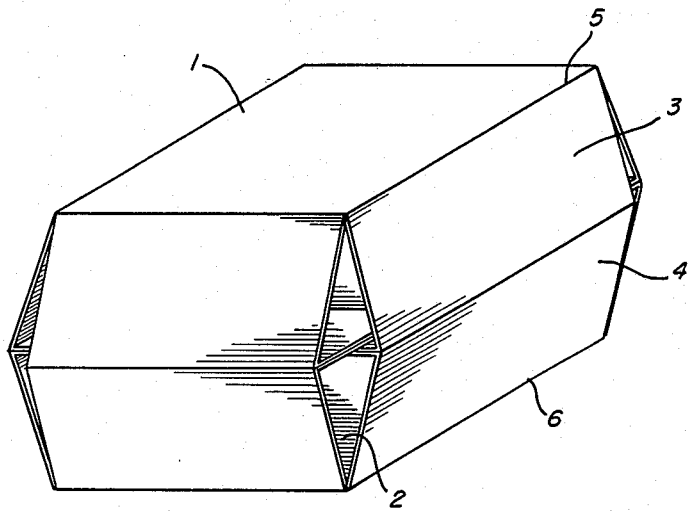
Figure 4:
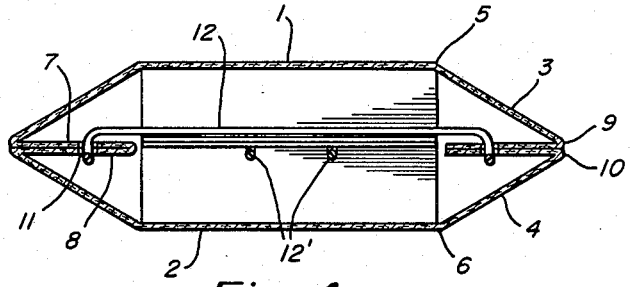

With references to FIGS. 1, 2, 3 and 4, a box of the invention consists of a rectangular or square top 1 and of a bottom 2 of like dimensions. The top and the bottom are connected by four side walls being composed of two halves 3 and 4 which are integral with the top and bottom along their edges 5 and 6 respectively. Each half side wall (3 and 4) is continued in the form of a tongue 7 and 8, the tongues being bent inwardly about their notched edges 9 and 10. The tongues are perforated by holes 11, or alternatively by slots, into which rubber bands, 12 and 12', are threaded, which pull opposite tongues towards each other, thereby straightening the sides 3 and 4 and raising the top off the bottom until a complete box is formed. Owing to the way of constructing the box, each pair of tongues 7 and 8 form a two-fold tongue connected by the rubber band which passes through the holes 11 of both tongue parts.

In order to flatten the box pressure is applied on the top 1 whereby the side walls are urged outwardly against the pull of the rubber bands, until the toy is completely flat with the top contiguous the bottom, with only the rubber bands positioned there-between.

Figure 5:
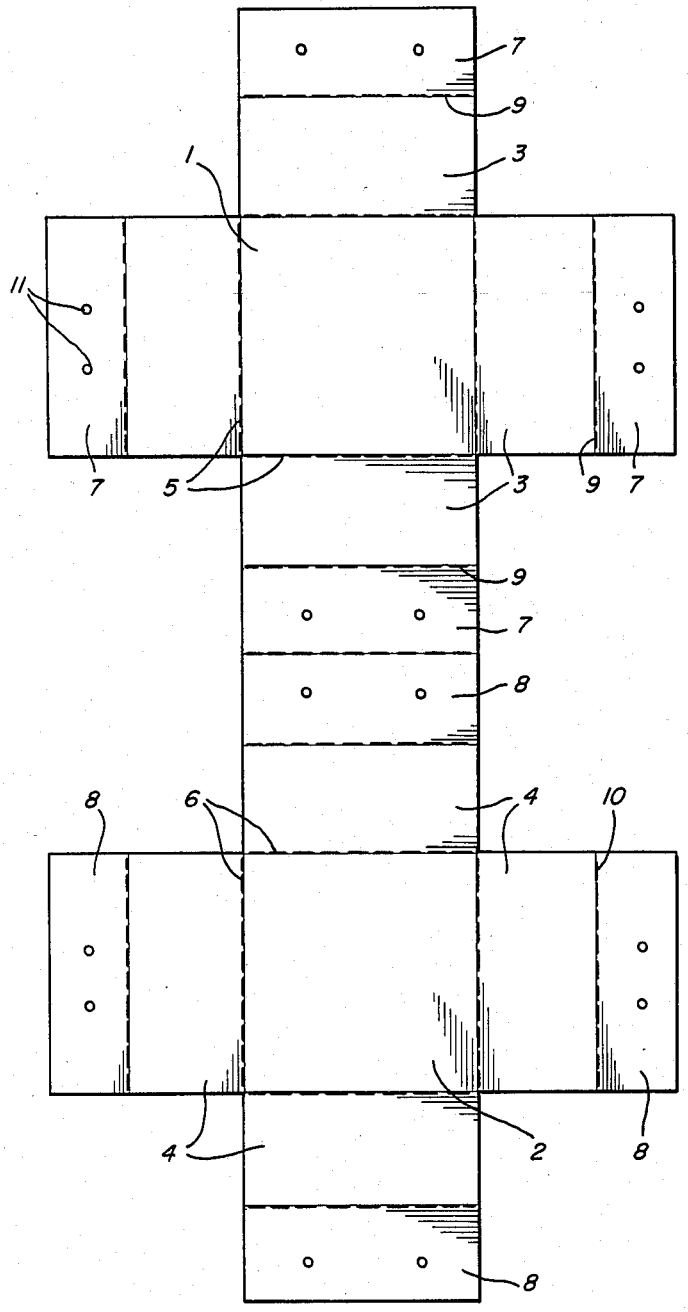
Figure 6:
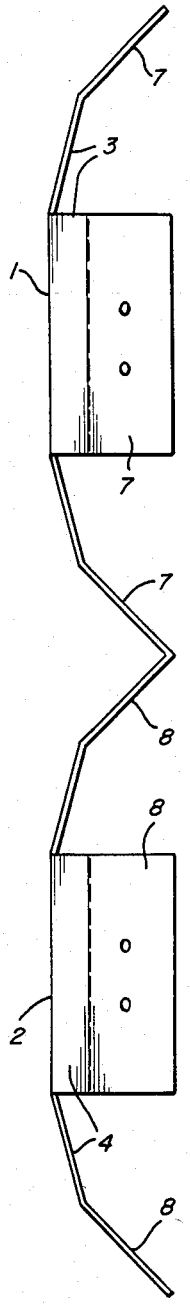

A preferred method of assembling the box consists of cutting or stamping a pattern in the shape of a duplex across as shown in FIGS. 5 and 6. Herein the side walls and the tongues are shown to be bent along the respective notches 5, 6, 9 and 10, in order to clearly explain the assembly of a box. Instead of stamping out one complete pattern as in FIG. 5, two separate patterns, each in the shape of a Greek cross, may be produced and bent into the appropriate shape. Each half comprises a top or bottom, four half side walls and four half tongues, which are subsequently assembled by threading two rubber bands through the holes 11 in the tongues and drawn together.

Although the aforedescribed embodiment appears to be the most convenient and simple way of producing and assembling a box from a cut-out pattern of cardboard or plastic material, other methods may be applied for making and assembling such boxes from premanufactured components.

For instance, instead of the split side walls with incorporated tongues, it is proposed to extrude side walls in the shape of a "T", wherein the beam represents the tongue, and the cross arms the two halves of the side walls. The ends of the side walls are subsequently attached to a rectangular top and bottom by gluing or rivetting.

As an alternative, a top or bottom may be extruded with two attached walls having tongues at right angles to the side wall plane. Two of such units are then united to form a complete box with elastic contracting means incorporated therein.

As a third alternative, the box may be assembled from two separate parts, each part comprising of a rectangular or square top or bottom respectively, with a half sidewall and tongue integral with each side of the rectangular or square central part.

The main object of the invention is to create an amusing toy, which comprises several boxes enclosed in a container in completely flattened state. They jump out when the lid is opened and appear as cubes or bricks respectively. Dependent on the pictures, portions of geographical maps, or symbols appearing on the tops and sides of the boxes, competitive games may be played, or they may be assembled into structures by smaller children using them as building stones, or as geographical maps.

There is an unending use for this kind of toy, and one of its main advantages is that it may be packed away in compacted state, so as not to occupy valuable space.

I claim:

1. A toy in the shape of a collapsible and expandable box folded from a blank of a stiff sheet material, said box having an inside and an outside, adapted to be collapsed and flattened into a flat Greek cross by pressure on its top and to be expanded into a perfect cube by internal contracting means, upon release of said pressure, said box comprising a top and a bottom of identical square configuration, in parallel alignment, four square side walls hingedly attached to the edges of said top and said bottom, each said side wall being adapted to fold outwardly about a central folding line parallel to said edge of said top and bottom, by pressure applied onto said top urging it towards said bottom, four tongues, each of a width equal to the width of said side walls, one tongue each being hingedly attached to the inside of one of said side walls along said central folding line, and each said tongue being provided with at least one perforation, the added length of two opposite tongues being substantially equal to the width of said top and said bottom, at least two elastic contracting means, having their ends attached to said tongues on opposite sidewalls in crossed alignment by means of said perforations, and adapted to pull said opposite walls into perfect planes perpendicular to the planes of said top and said bottom, upon release of pressure on said top, whereby each said side wall is prevented from being pulled inwardly by said tongues attached to the adjoining side walls.

2. The box of claim 1, wherein said elastic contracting means are in the shape of at least two elastic bands, each attached to two opposite tongues by means of said perforations.

3. The box of claim 1, wherein said elastic contracting means are in the shape of at least two helical springs, each spring having its ends attached to two opposite tongues by means of said perforations.

4. The box of claim 1, wherein said perforations in said tongues are in the shape of circular holes.

5. The box of claim 1, wherein said perforations in said tongues are in the shape of slots.

6. The box of claim 1, comprising pictures applied to the outer surface of its top, its bottom and/or its side walls in the form of maps, symbols, numbers or the like.

7. The box of claim 1, wherein each said square side wall is composed of two equal, separate, rectangular portions, each said side wall portion hingedly attached by one of its long sides to one edge of said top and said bottom respectively, while its other long side is hingedly attached to a long side of a rectangular tongue portion of a size substantially identical with the size of said wall portions, wherein each of said tongues is composed of two adjacent tongue portions.

8. The box of claim 7, made of a blank of cardboard sheeting adapted to be folded to form said box, in the form of two identical Greek crosses hingedly attached to each other by one of their arms, each cross comprising a central square portion representing top and bottom respectively and four flap portions outwardly extending from the four edges of said square portion, each said flap constituting a side wall portion adjacent said square portion and a tongue portion at the end of each flap, said blank being notched along the lines defining the borders between the respective square portion, the side portions and the tongue portions to effect hinged connection between said portions.

9. The box of claim 7, made of a blank of plastic sheeting adapted to be folded to form said box, in the form of two identical Greek crosses hingedly attached to each other by one of their arms, each cross comprising a central square portion representing top and bottom respectively and four flap portions outwardly extending from the four edges of said square portion, each said flap constituting a side wall portion adjacent said square portion and a tongue portion at the end of each flap, said blank being notched along the lines defining the borders between the respective square portion, the side portions and the tongue portions to effect hinged connection between said portions.

* * * * *